United States Patent [19]

Childers

[11] Patent Number: 4,512,111

[45] Date of Patent: Apr. 23, 1985

[54] KNIFE BLADE SHARPENER

[76] Inventor: Don A. Childers, 11259 Casa St., Ventura, Calif. 93004

[21] Appl. No.: 436,731

[22] Filed: Oct. 26, 1982

[51] Int. Cl.[3] ..... B24B 23/00

[52] U.S. Cl. ..... 51/157; 51/221 BS; 76/82; 76/DIG. 9

[58] Field of Search ..... 51/157–159, 51/221 BS, 285, 214, 221 R, 151, 64, 220, 238 R; 269/289, 71; 76/81.7, 82.2, 88, 82

[56] References Cited

U.S. PATENT DOCUMENTS

| | | | |
|---|---|---|---|
| 1,770,538 | 7/1930 | Warner | 51/220 |
| 2,128,591 | 8/1938 | McGill | 51/158 |
| 2,131,626 | 9/1938 | Keith | 51/158 |
| 2,435,671 | 2/1948 | Clark et al. | 51/158 |
| 2,893,179 | 7/1959 | Sperow | 51/221 |
| 3,797,334 | 3/1974 | Sinclair | 76/88 |
| 3,861,088 | 1/1975 | Brieco | 51/216 A |
| 3,882,642 | 5/1975 | Sykes | 51/157 |
| 3,932,964 | 1/1976 | Simms | 51/220 |
| 3,950,890 | 4/1976 | Gilbert | 51/221 R |
| 4,078,338 | 3/1978 | Baughcom | 51/221 R |

*Primary Examiner*—Frederick R. Schmidt
*Assistant Examiner*—Robert A. Rose
*Attorney, Agent, or Firm*—Shlesinger, Arkwright, Garvey & Fado

[57] ABSTRACT

A knife is supported on a movable saddle support member and the knife blade maintained at a set predetermined angle with respect to a sharpening stone during the sharpening process.

10 Claims, 5 Drawing Figures

KNIFE BLADE SHARPENER

This invention relates to a device for sharpening a knife blade and more particularly, to a device for sharpening the blade edges of a utility knife wherein the blade is maintained at a set predetermined angle with respect to a sharpening stone during the sharpening process.

BACKGROUND OF THE INVENTION

Many devices have been developed over the years for honing or sharpening the edges of cutting or chiselling tools. The majority of these devices utilize specialized clamping devices for supporting the blade of the tool to be sharpened. Several of such devices are shown by Baughcom, U.S. Pat. No. 4,078,338; Keith, U.S. Pat. No. 2,131,626; McGill, U.S. Pat. No. 2,128,591; Sperow, U.S. Pat. No. 2,893,179; and Gilbert, U.S. Pat. No. 3,950,899.

Each of the above mentioned patents discloses the use of screw clamp devices which must be manipulated each time the tool is positioned for the sharpening process. Manipulation of such clamp devices is both troublesome and time consuming.

Other tool sharpening devices are disclosed by Sinclair, U.S. Pat. No. 3,797,334, and Sykes, U.S. Pat. No. 3,882,642. In each of the above patents, a reciprocating motion of the knife blade upon a sharpening surface is utilized in order to obtain the required results.

Only Sinclair, of all the previously mentioned patents, discloses a device which is suitable for sharpening a knife having an acute blade angle, that is, a blade ending at a sharp point.

SUMMARY AND OBJECTS OF THE INVENTION

The present invention differs from the prior art by providing a device for sharpening the edge of a knife having an acute blade angle, wherein the knife edge is maintained at a predetermined angle with respect to a sharpening stone during the sharpening process thereby imparting a predetermined angular sharpened edge to the blade of the knife. In addition, the blade is supported for rotational as well as translational movement during contact with the sharpening stone surface.

The device includes a base member, a sharpening stone supported in the base member, a slider unit supported for rotational and translational movement within the base member, and a saddle unit pivotally connected and supported on the slider unit. The saddle unit includes slots for receiving the shank of a utility knife and inclined surfaces for supporting the blade of the utility knife at a predetermined angle with respect to the sharpening stone.

It is therefore an object of the present invention to provide a device for sharpening the blades of knives of the group commonly referred to as Exacto knives.

It is another object of the present invention to provide a device for sharpening knives having acute blade angles.

It is a further object of this invention to provide a sharpening device for maintaining a predetermined anglular orientation between the knife blade and the sharpening stone.

It is a further object of this invention to provide a device for imparting rotational as well as translational movement of the blade upon the sharpening stone.

A still further object of this invention is to provide a sharpening stone and a movable blade support which is incorporated in a compact, unitary structure.

A still further object of this invention is to provide a sharpening device which is inexpensive to manufacture.

A still further object of this invention is to provide a device which is simple to operate.

A still further object of this invention is to provide a sharpening device which is durable in construction.

A still further object of this invention is to provide a sharpening device which eliminates the need for special clamping devices for securing a blade at a set angle with respect to a sharpening stone.

The foregoing and other objects and advantages of this invention will appear from the following detailed description, taken in connection with the accompanying drawings, in which.

DETAILED DESCRIPTION OF THE DRAWINGS

Figure 1:
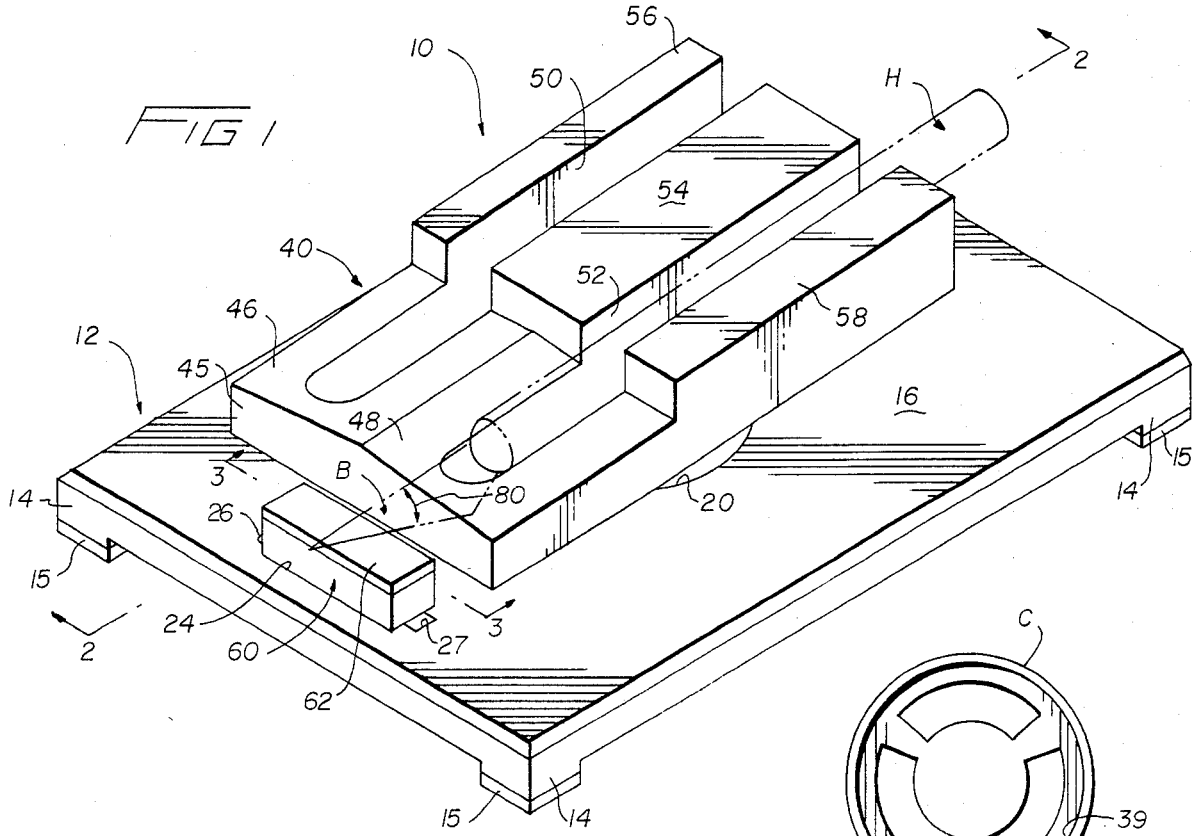
FIG. 1 is a perspective view of the sharpening device of the present invention with the utility knife and blade to be sharpened shown in dotted lines.
Figure 2:
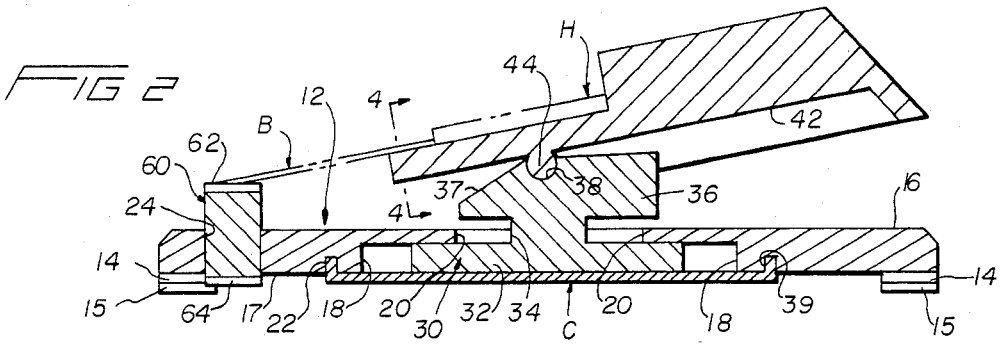
FIG. 2 is a cross sectional view of the device of FIG. 1 taken substantially along line 2—2 of FIG. 1 and viewed in the direction of the arrows.

Referring now to FIGS. 1 and 2, knife sharpening device 10 includes a base member 12. Legs 14 extend from each corner of base member 12. Attached to the bottom of legs 14 are friction pads 15. Base member 12 includes a top surface 16 and a bottom surface 17. A circular recess 18 is formed in bottom surface 17 of base member 12. Concentric with, and entering into circular recess 18 is a circular opening 20 formed in top surface 16 of base member 12. A circular notch 22 is formed in bottom surface 17 of base member 12 and is concentric with circular recess 18. A rectangular opening 24 is formed in the forward portion of base member 12. Recessions 26 and 27 are formed in top surface 16 of base member 12 and are associated with rectangular opening 24.

Positioned within circular recess 18 is a slider unit 30 including a disk-shaped slider base 32, a cylindrical post 34 extending upwardly from slider base 32 and a generally wedge-shaped slider head 36 supported upon cylindrical post 34. Slider head 36 includes an upper declined surface 37. An elongated slot 38 is formed in the upper surface of slider head 36 and extends transversely thereacross.

A cap member C including upwardly extending circumferential lip 39 is secured within circular notch 22 of base member 12.

Figure 5:
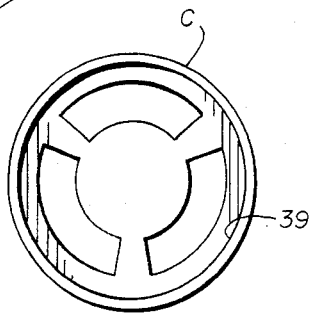
FIG. 5 is a top plan view showing the cap element of FIG. 2.

Cap member C is shown in detail in FIG. 5. Slider base 32 is supported upon cap member C. Slider base 32 has a diameter less than the diameter of circular recess 18, thereby providing a horizontal clearance for rotational and translational movement of slider base 32 within circular recess 18. A vertical clearance of approximately 0.002 inches is provided between the upper surface of slider base 32 and that portion of base member 12 extending above circular recess 18. This vertical clearance permits slider base 32 to move freely upon cap member C, while at the same time prevents cocking of slider base 32 within circular recess 18.

Supported on slider unit 30 is a saddle unit 40. Saddle unit 40 includes a generally rectangular slot 42 formed in the base thereof. Transversely positioned within rectangular slot 42 integral with its surface is an elongated engagement bar 44. FIG. 2 shows saddle unit 40 supported upon slider head 36 with slider head 36 partially received within rectangular slot 42. Additionally, engagement bar 44 is securely interlocked within elongated slot 38. Interengaging members 38 and 44 allow saddle 40 to pivot upon slider unit 30.

Figure 4:
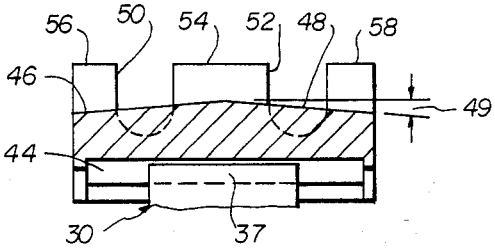
FIG. 4 is a sectional view along line 4—4 of FIG. 2 and viewed in the direction of the arrows.

As best shown in FIGS. 1 and 4, saddle unit 4 includes a front face 45, as well as support surfaces 46 and 48. Surfaces 46 and 48 are angularly declined from the horizontal as indicated by reference 49 in FIG. 4. Elongated knife handle receiving slots 50 and 52 are formed in each surface 46 and 48 and extend longitudinally with respect to saddle unit 40. Raised portions 54, 56 and 58 border the sides of slots 50 and 52.

As shown in dotted lines in FIG. 1, a handle H of a utility knife is supported within slot 52. Attached to handle H is an acutely angled blade B, a portion of which lies flush upon declining surface 48, while the remainder of blade B extends beyond front face 45 of saddle unit 40. In this manner blade B is maintained at a predetermined angle corresponding to the angular decline 49 of support surface 48. The preferred angular decline of surfaces 46 and 48 is 14° from the horizontal.

Figure 3:
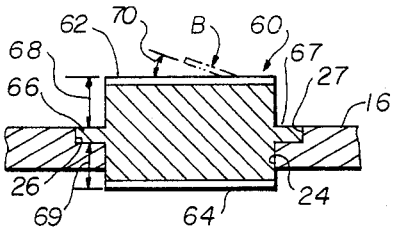
FIG. 3 is a cross sectional view of the sharpening stone and base member of FIG. 1 taken along line 3—3 of FIG. 1, and viewed in the direction of the arrows, and showing the angular relationship of the knife blade with respect to the sharpening stone.

As best shown in FIG. 3, a sharpening stone 60, including sharpening surfaces 62 and 64 is supported within rectangular opening 24 by means of projecting tabs 66 and 67 which are received within correspondingly shaped recessions 26 and 27 respectively. Sharpening surface 62 is positioned horizontally above top surface 16 at a predetermined height indicated by reference arrow 68. Sharpening stone 60 may be inverted so that sharpening surface 64 would rest in a horizontal plane above top surface 16 at a second predetermined height corresponding to arrow 69. Heights 68 and 69 are determined by several geometrically factors. These factors include angular decline 49 of surfaces 46 and 48, the angle of blade B as indicated by reference 80, as well as the height of pivotal connections 38 and 44 above top surface 16 of base member 12.

OPERATION

The knife sharpening process begins by placing handle H of the utility knife within slot 52, with a portion of blade B resting flush upon surface 48 and the remaining portion of blade B extending beyond front face 45 of saddle unit 40 above sharpening surface 62. The sides of saddle 40 are gripped between the thumb and third finger while the index finger maintains pressure upon handle H. Next, saddle unit 40 is pivoted so as to cause the edge of blade B to make contact across horizontally positioned sharpening surface 62 while maintaining blade B at a predetermined constant angle with respect to the stone surface. This angle is indicated by reference numeral 70 in FIG. 3. Next, slider base 32, which is supported upon cap member C, is pushed back and forth and around within circular recess 18 thereby imparting a flush wiping contact between the edge of blade B upon sharpening surface 62. After several sharpening motions, knife handle H is removed from slot 52 and placed in slot 50 while the above process is repeated so as to sharpen the opposite side of the blade edge.

If one were to sharpen a blade having an acute angle greater than angle 80 of blade B in FIG. 1, sharpening stone 60 would be inverted to as to position sharpening surface 64 horizontally at a height 69 above top surface 16 of base member 12. Thus, height 69 is less than height 68 in order to compensate for a blade having a larger blade angle. It should be noted that heights 68 and 69 are predetermined to correspond to knife blades of known angular dimensions. Variations of the arrangement shown and described herein for positioning a sharpening surface at a predetermined height above the base member may be substituted therefore and are considered within the scope of this invention.

While this invention has been described in connection with different embodiments thereof, it will be understood that it is capable of further modifications and this application is intended to cover any variations, uses, or adaptations of the invention following, in general, the principles of the invention and including such departures from the present disclosure as come within known or customary practice in the art to which the invention pertains, as may be applied to the essential features hereinbelow set forth and followed in the scope of the invention or the limits of the appended claims.

What is claimed is:

1. A device for shaping and sharpening the blade of a utility knife or the like, comprising:

(a) a base member having a flat top surface and a second flat surface disposed parallel and below the top surface, (b) a sharpening stone firmly mounted on the base member and having a flat sharpening surface parallel to the flat top surface of the base member, (c) the base member having a large circular opening in its flat top surface aligned with and spaced a predetermined distance fron the sharpening stone, (d) a slider unit consisting of a block positioned in sliding engagement with the base member including a slider base disposed below the top surface and in general alignment with the circular opening so as to slide parallel with the top surface, the slider base having a planar surface of larger area than the circular opening and in close sliding engagement with the second flat surface such that the slider unit has firm, fixed planar movement, and including base engaging means for holding the slider unit in sliding engagement, (e) a slider head disposed above the top plate which is supported on the slider base and connected thereto by a cylindrical support post on the slider unit being of substantially smaller diameter than the circular opening in the top surface and extending through the circular opening to freely permit two degrees of substantial planar translational movement of the slider unit with respect to the sharpening stone, and (f) a saddle unit being connected through a pivotal connection to the slider base head which permits movement along an axis parallel to the plane of translation of the slider unit and also having a knife receiving upper surface for supporting the knife blade transversely with respect to the sharpening stone flat surface and bringing it into contact therewith at an acute fixed angle, such that a flush wiping contact of the edge of the knife blade is made with the upper surface of the sharpening stone.

2. A device as in claim 1 and wherein:

(a) said knife receiving upper surface has a support surface on which the knife blade rests which declines at a predetermined angle from the horizontal.

3. A device as in claim 1 and wherein:

(a) the sharpening stone has two parallel spaced sharpening surfaces on a mounting means for positioning one sharpening surface at a first predetermined height above the flat top surface of the base member and the other sharpening surface at a second predetermined height above the top surface of the base member.

4. A device as set forth in claim 1 and wherein:

(a) said slider unit including a disk-shaped slider base of substantially greater diameter than the circular opening, a generally wedge-shaped slider head above said slider base and the cylindrical post interconnecting said slider base and said slider head.

5. A device as set forth in claim 1 and wherein:

(a) said slider head including an upper surface, and (b) a transversely extending pivotal connection in said upper surface which interengages with the saddle unit.

6. A device as in claim 4 and wherein:

(a) said saddle unit including top and bottom surfaces, (b) a notch formed in said bottom surface of said saddle unit, (c) a bar on said slider head transversely mounted in said notch, and (d) said slider head positioned within said notch with said bar of said saddle unit engaged in a slot of said slider head.

7. A device as in claim 6 and wherein:

(a) said top surface of said saddle unit declining at a predetermined angle from the horizontal, (b) knife handle receiving slots are formed in said top surface, and (c) said top surface supporting an acutely angled knife blade flush thereupon and at said predetermined angle.

8. A device as in claim 3 and wherein:

(a) said saddle unit including top surfaces declining at a predetermined angle from horizontal and for supporting an acutely angled knife blade thereon, (b) said height of said saddle unit above said base member being greater than said height of said sharpening stone surfaces above said base member, and (c) said heights of said saddle unit and said sharpening stone surfaces above said base member being interrelated and dependent upon the degree of angular decline of said top surfaces of said saddle unit as well as the degree of acuteness of said knife blade.

9. A device for sharpening the edge of an acutely angled blade of a utility knife or the like comprising:

(a) a base member, (b) a sharpening stone mounted upon said base member, and, (c) a slider unit slidably supported within said base member and connected through a pivotal connection to a saddle unit on which the knife blade is supported for translational, rotational and pivotal movement with respect to said base member and with respect to said sharpening stone and for maintaining said acutely angled knife blade in contact with and at a predetermined angle with respect to said sharpening stone thereby allowing a flush wiping contact at the edge of said knife blade upon said sharpening stone during sharpening thereof, (d) said slider unit including a disk-shaped slider base and a generally wedge-shaped slider head above said slider base and a cylindrical post which interconnects the slider base and the slider head, and (e) said slider head and said saddle unit being interconnected through their top and their bottom surfaces respectively by a transverse bar and notch assembly in a plane parallel to the surface of the sharpening stone.

10. A device as in claim 9 wherein:

(a) the top surface of the saddle unit declines at a predetermined angle with respect to the surface of the sharpening stone, (b) knife receiving slots are formed in said declining surface, and (c) said top surface of said saddle unit supports an acutely angled knife blade flush thereupon and at said predetermined angle.

* * * * *